United States Patent [19]

Bachofer

[11] 4,278,918

[45] Jul. 14, 1981

[54] DISPLAY PANEL DRIVER CIRCUIT

[75] Inventor: Kenneth W. Bachofer, Elk River, Minn.

[73] Assignee: Modern Controls, Inc., Elk River, Minn.

[21] Appl. No.: 135,657

[22] Filed: Mar. 31, 1980

[51] Int. Cl.[3] ..... H05B 41/30

[52] U.S. Cl. ..... 315/169.4; 307/255; 315/169.2; 340/789

[58] Field of Search ..... 315/169.2, 169.4; 307/255; 340/776, 789, 811

[56] References Cited

U.S. PATENT DOCUMENTS

| | | | |
|---|---|---|---|
| 3,649,851 | 3/1972 | Cohen | 307/255 X |
| 3,673,431 | 6/1972 | O'Brien | 307/255 X |
| 4,002,946 | 1/1977 | Liang | 340/789 X |
| 4,080,597 | 3/1978 | Mayer et al. | 340/773 X |
| 4,176,298 | 11/1979 | Kirchner et al. | 315/169.2 |

OTHER PUBLICATIONS

Kleen, *High-Level Driver for Gas Discharge Panel,* IBM Technical Disclosure Bulletin, vol. 16, No. 9, Feb. 1974, pp. 2941–2942.

*Primary Examiner*—Eugene R. LaRoche
*Attorney, Agent, or Firm*—Paul L. Sjoquist

[57] ABSTRACT

Low impedance gas display panel voltage driver circuit is disclosed for driving conductor segments imbedded in gas display panel, wherein such conductor segments present a capacitive load, and where input to driving circuit is digital logic signal from standard transistor-transistor logic (TTL) circuit, the driver circuit and variations thereof being suitable for coupling to one or a plurality of conductor segments in a gas display panel.

6 Claims, 3 Drawing Figures

30
A
B
S
WS
IW
X
Y
41
42
43
44
45
$I_1$
$I_2$
$I_3$
$I_4$
$I_5$
GATE

DISPLAY PANEL DRIVER CIRCUIT

BACKGROUND OF THE INVENTION

This invention relates to circuitry for driving or energizing gas display panels, and more specifically relates to driving circuits for panels of the type disclosed in U.S. Pat. No. 4,080,597, issued Mar. 21, 1978.

U.S. Pat. No. 4,080,597 discloses an apparatus for providing a visual information screen of the type formed from a plurality of gas cells wherein electrical voltages are capacitively coupled to selected gas cells to cause gas ignition and subsequent light emission. The patent describes a gas display panel utilizing a single plane of parallel spaced conductors to ignite gas in channels perpendicularly aligned with respect to the conductors and capacitively isolated therefrom. A "gas cell" is defined by the region within a channel between two parallel conductors, and the magnitude of the voltage potentials on the respective adjacent conductors determines whether or not a "gas cell" becomes ignited or extinguished. The voltage utilized for operating a gas display panel of this type is derived preferably from a single voltage source, typically in the range of 200–250 volts, and the driver circuits utilized for controlling such voltage are preferably relatively fast-operating, high voltage switching circuits. Since the gas display panel is typically utilized in conjunction with digital equipment operating at typical digital equipment logic voltage levels (0–5 volts DC), it is preferable that the driver circuit for such a gas display panel be responsive to such digital logic low voltage signals.

U.S. Pat. No. 4,176,298, issued Nov. 27, 1979, and entitled "Display Panel Apparatus and Method of Driving" discloses a sequence of voltage drive signals which is advantageously used for energizing a display panel of the general type relating to this invention. This patent teaches that the adjacent electrical conductor segments which are embedded in the gas display panel are preferably activated according to a preferred timing sequence so as to more reliably control the respective ignition and extinguishing of the "gas cells" within the panel, and discloses a repetitive timing cycle which is utilized to activate the display driver circuits, the timing cycle preferably having pulse time durations on the order of 5–10 microseconds. Such a timing sequence is readily designed by utilizing state-of-the-art circuits in digital logic design and such circuits may be utilized with the present invention.

A further example of a display panel which may be utilized with the present invention is found in copending U.S. Patent Application Ser. No. 046,706, filed June 18, 1979 and entitled "Improvement in Plasma Display Panel". Disclosed therein is a flat glass display panel having closely spaced conductor segments, wherein some conductor segments are connected together to form a plurality of conductor segments driven by a single driver circuit and other conductor segments are individually driven by a voltage driver circuit.

In the prior art the problem of coupling display panel driver circuits, which must necessarily operate in a voltage range exceeding 200 volts, with digital logic circuits operating in the 0–5 volt range has been solved by using voltage and current boosting components such as transformers. These components are typically used as power couplers to enable digital logic circuits to generate signals of sufficient drive power to control relatively higher voltage switching circuits. An example of such a prior art circuit arrangement is described more fully hereinafter; among the many disadvantages of such circuit arrangements are their significantly higher cost, higher weight and space requirements, nonuniform electrical characteristics and their propensity toward introducing spurious and destructive electrical noise signals into the system.

SUMMARY OF THE INVENTION

The present invention include a complementary pair of emitter-coupled voltage driver circuits which are directly connected to gas display panel conductor segments, the base electrodes of the two driver circuits being interconnected so as to be commonly driven by either of two switching transistors which are in turn driven by digital logic signals capacitively coupled to their inputs. The input switching circuits are a complementary pair NPN/PNP which cause one or the other, but not both, of the driver circuits to activate, thus applying either a high voltage or a ground potential to the conductor line segments driven by the driver circuit.

BRIEF DESCRIPTION OF THE DRAWINGS

The preferred embodiment of the present invention is described hereinafter, and with reference to the appended drawings, in which.

DESCRIPTION OF THE PREFERRED EMBODIMENT

Figure 1:
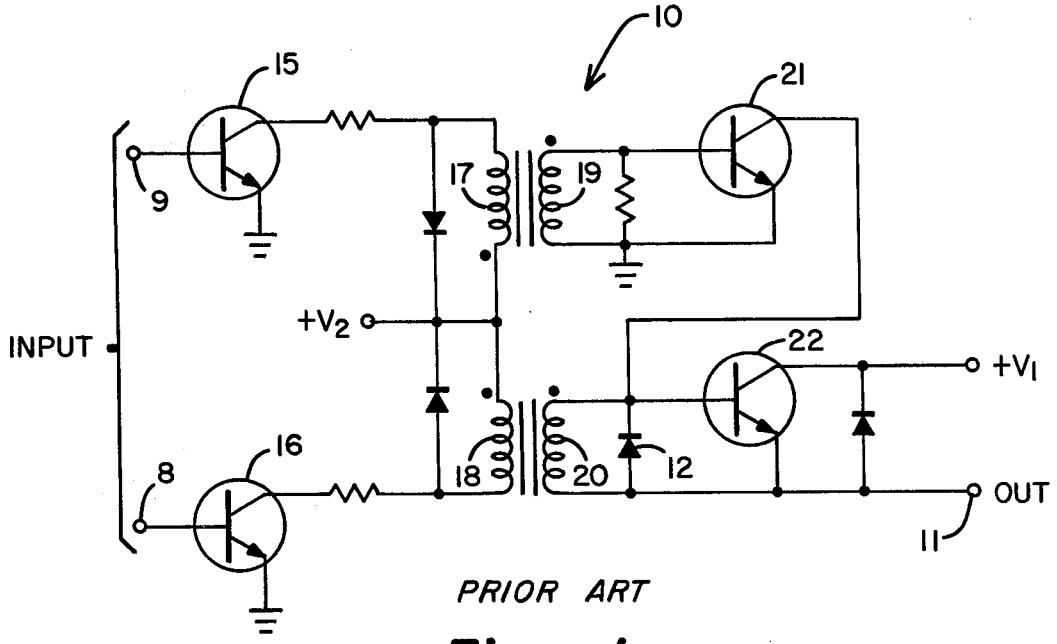
PRIOR ART Fig. 1
FIG. 1 shows a prior art driver circuit.

FIG. 1 is an example of a prior art circuit 10 of the type used to generate voltage pulses to be applied to the conductors in a display panel. Circuit 10 includes a pair of high current capacity transistors 15 and 16, the inputs to which may be received from standard transistor-transistor logic (TTL) and the outputs from which comprise a relatively high current signal, on the order of 500 milliamps. Transistors 15 and 16 are connected to transformer primary windings 17 and 18 respectively. Transformer secondary 19 couples a base drive signal into driver transistor 21; transformer secondary 20 couples a base drive signal into drive transistor 22. Drive transistors 21 and 22 are connected to an output terminal 11 which is connected to a plurality of conductors (not shown) in the gas display panel of the type of interest to the present invention. If drive transistor 21 is energized by a signal from transformer secondary 19, output terminal 11 is clamped to ground via a current path through diode 12 and transistor 21. If transistor 22 is energized by a signal from secondary winding 20, output terminal 11 is coupled to the positive supply voltage ($+V_1$) through a current flow path through transistor 22. Drive transistor 21 is energized by a TTL logic signal applied at input 9 to transistor 15; drive transistor 22 is energized by a TTL logic drive signal applied at input terminal 8 to transistor 16. Thus, the appropriate TTL logic signal applied at either input terminals 8 or 9 will cause output terminal 11 to become clamped to ground or coupled to the positive voltage supply ($+V_1$). These voltage levels are coupled via connections (not shown) to a plurality of conductors within the gas display panel.

The foregoing described circuit has been found necessary for driving conductors in a gas display panel because of the special design problems inherent with such panels. For example, the conductor line segments in a gas display panel typically are highly capacitive and such capacitance causes switching problems when attempting to rapidly turn on and off a voltage supply on the order of 200–250 volts. The transformer coupled switching circuit of FIG. 1 provides the high current signals necessary to turn on and to turn off drive transistors 21 and 22 under these conditions. Diode 12 is utilized not only to provide a current flow path to drive transistor 21, but also to assist in the reverse biasing of transistor 22 and to thereby ensure that transistor 22 turns off rapidly. Conversely, when transistor 22 is turned on diode 12 becomes reversed biased and effectively decouples drive transistor 21 from the output circuit.

There are a number of disadvantages inherent with the use of the transformer coupled driver circuit described above. The transformer is an expensive circuit element and requires careful design for adequate operation in conjunction with display panels. The transformer inherently produces noise and ringing signals which cause voltage disturbances which are sometimes coupled into the gas display panel conductors themselves to unreliably operate the panel. Since a display panel utilizes a plurality of conductor segments, the number of which may vary depending upon the function and size of the display panel, the transistor coupled driver circuits must be especially tailored for the particular design application in which they are to be used. For a typical gas display panel, there are some driver circuits which are coupled to only one or two conductor line segments within the panel; also, there are a number of driver circuits which are coupled to a significant plurality of conductor segments within the panel; this variation in loading creates a wide variation in the capacitance loading which may be imposed upon the driver circuit. While it has been found that individual circuit components may be modified in size to compensate for capacitive loading effects, this has created the need for tailoring a particular transformer coupled driver circuit to the particular conductor line segments to which it is attached, thereby limiting the interchangeability and increasing the cost of using such driver circuits.

Figure 2:
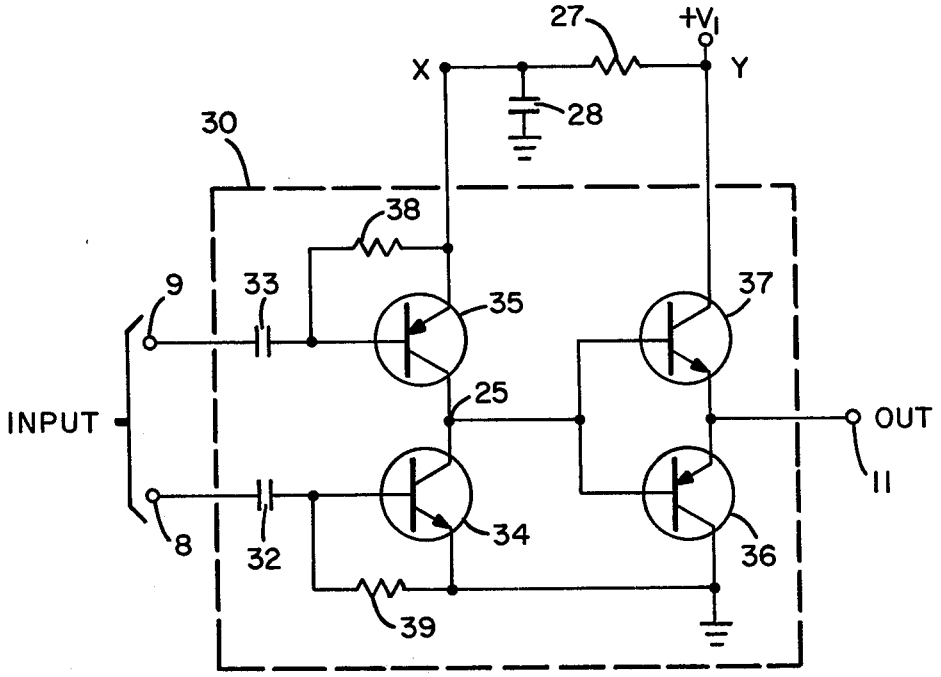
FIG. 2 shows the driver circuit of the present invention.

FIG. 2 shows a driver circuit 30 constructed according to the teachings of the present invention. Input terminals 8 and 9 are, as before, connected to TTL logic circuits for receiving input logic signals for driving the gas display panel. The TTL signals received at input terminals 8 and 9 are respectively capacitively coupled via capacitors 32 and 33 to transistors 34 and 35. When transistor 34 is driven into conduction it causes transistor 36 to conduct heavily, clamping output terminal 11 to ground potential through transistor 36. When transistor 35 conducts, it causes transistor 37 to heavily conduct, thereby coupling the $+V_1$ voltage supply to output terminal 11. In this manner, output terminal 11 may be either clamped to ground or to the $+V_1$ supply by the TTL logic signals applied at input terminals 8 and 9.

A negative-going input signal received at input terminal 9 is capacitively coupled to the base of transistor 35. This causes transistor 35 to switch into conduction, thereby causing the voltage at node 25 to go positive. This voltage is direct-coupled to the base of drive transistors 36 and 37, causing transistor 37 to switch into conduction and transistor 36 to cut off. When transistor 37 conducts, the voltage supply $+V_1$ is coupled to output terminal 11 via transistor 37 and to panel conductors coupled thereto.

When a positive-going input signal is received at input terminal 8, it is capacitively coupled to the base of transistor 34, causing it to switch into conduction. When transistor 34 conducts the voltage at common node 25 drops toward zero, which voltage drop is directly connected to the bases of transistor 36 and transistor 37. This in turn causes transistor 37 to cut off, and causes transistor 36 to switch into conduction, thereby clamping the voltage at output terminal 11 to ground potential.

The voltage supply $+V_1$ is preferably in the range of 150–300 volts DC. Resistor 27 is a decoupling resistor of low resistance value, approximately 10 ohms. Capacitor 28 is preferably about 1 microfarad, and is used to develop an AC ground potential at the emitter junction of transistor 35. Resistors 38 and 39 are biasing resistors which may have nominal resistance values of 470 ohms, although the resistance values of these components may be varied over a wide range.

The transistors shown in FIG. 2 may be selected from commercially available types. The following transistor types have provided good results in actual practice, wherein the type designations are of the manufacturer, Motorola Inc.

| Transistor | Type |
|---|---|
| 34 | MPS-A42 |
| 35 | MPS-A92 |
| 36 | MJE-350 |
| 37 | MJE-340 |

Figure 3:
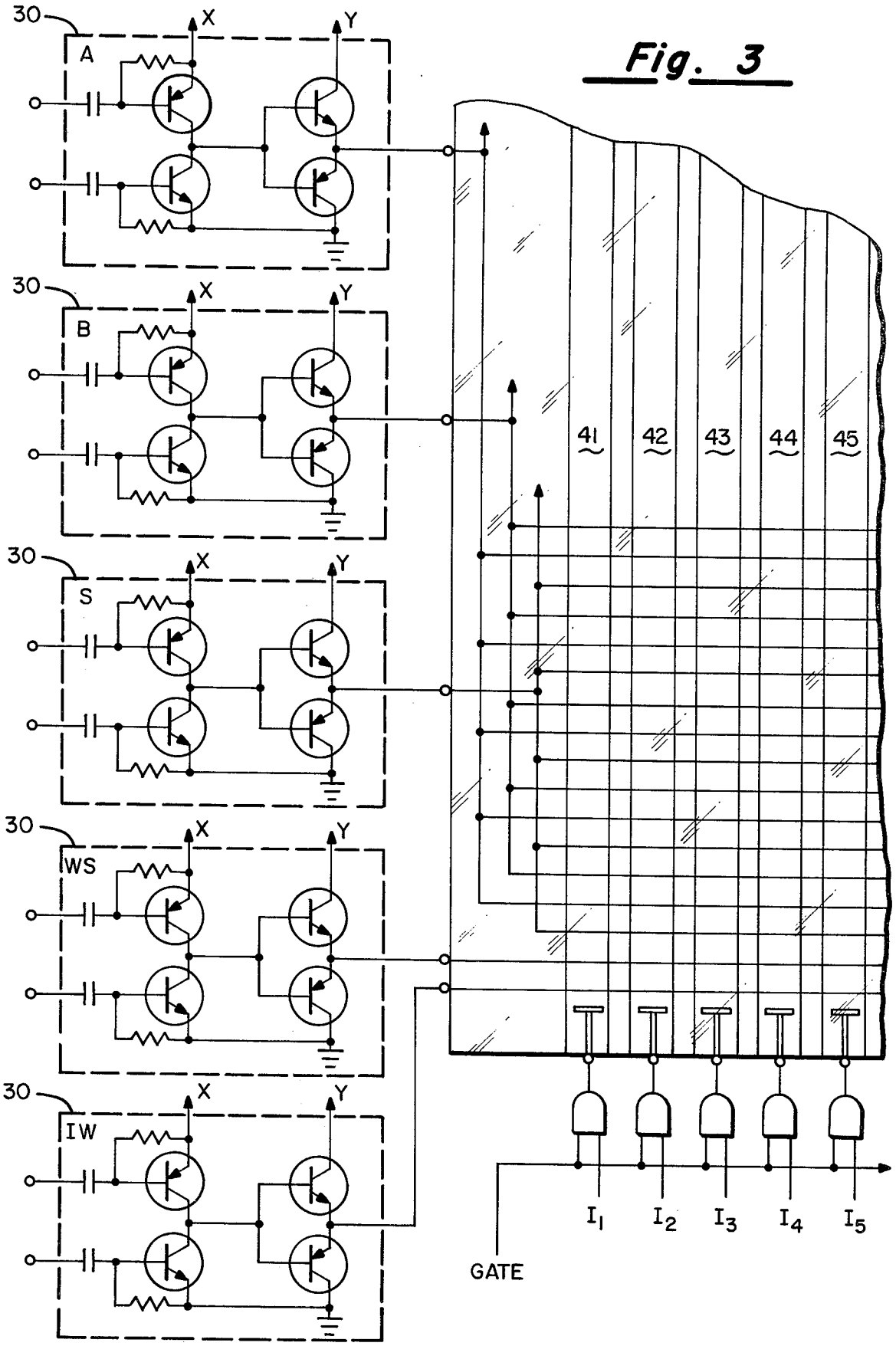
FIG. 3 shows the connection of the present invention to a typical display panel.

FIG. 3 shows a plurality of the circuits of the present invention connected to the respective input conductors of a display panel. For convenience each of the driver circuits has been identified by an alphabetic character A, B, S, $W_s$, $I_w$. It can be seen that the individual circuits are identical in design, the alphabetic designation merely indicating different functional and panel connections for the circuits. Circuit A is electrically connected to a plurality of conductor lines within the display panel, and it can be noted that the circuit is connected to every third horizontal conductor line. Similarly, circuit B is connected to horizontal lines adjacent to the conductor lines connected to circuit A, and is also connected to every third horizontal conductor line. Likewise circuit S is connected to every third conductor line adjacent to the lines connected to circuit A. It will be noted that circuit $W_s$ and $I_w$ are each connected to only a single line near the input terminals $I_1$, $I_2$, . . .

The energization of circuit A by means of an appropriate input signal at its input terminals causes a voltage to be applied to all of the panel conductors connected to Circuit A. As hereinbefore described, this voltage is either near ground potential, or near the supply voltage potential which is typically 150–300 volts. Similarly, activation of circuits B and S, or either of them, will cause voltages to become applied to all of the panel conductors which are respectively connected to these circuits. By properly time phasing the signals to the respective drive circuits, it is possible to control the voltage applied to adjacent lines within the display panel in a manner to both cause ignition of the gaseous mixture in the panel and to controllably shift the ignited regions within the panel along the gas channels which confine respective volumes of gas. The gas channels 41, 42, 43, . . . , are respectively aligned adjacent the input conductors $I_1$, $I_2$, $I_3$, . . . , and the initial ignition of the gas in the end regions of respective channels are controlled by signals applied to these input conductors. Once a gaseous ignition region has been introduced into the end of one of the channels in the panel, the ignition region may be selectively shifted along the channel by virtue of the controlled voltages applied to the S, A, B circuits. A sequence of controlled voltages which is suitable for accomplishing the selective shifting of gas ignition regions is shown in the aforementioned U.S. Pat. No. 4,176,298.

In operation, the circuits of the present invention are selectively driven by a logic signal timing pattern such as is shown in the aforementioned patent, and the respective conductor segments are selectively energized to generate voltage excitation signals to selectively ignite a gas mixture contained within the gas channels. The logic signal timing is arranged so as to propagate gaseous ignition regions along the gas channels or to retain gaseous ignition regions in fixed positions along the gas channels. The composite pattern of such gaseous ignition regions is controlled by selective energization of the $I_1$, $I_2$, $I_3$ . . . conductors, so as to provide a visual representation of characters, numerals or other configurations meaningful to the operator of such panels.

The gas display panel construction, which is only partly portrayed in FIG. 3, may take many different forms. For example, the length of the respective gas channels 41, 42, . . . may be varied over wide ranges depending upon particular display panel applications. As the length of the gas channels is increased the number of transverse parallel conductor segments is correspondingly increased, thereby increasing the capacitive loading effects on the respective driver circuits. Also, the number of gas channels 41, 42, . . . may be varied in particular display panel applications, thereby varying the lengths of the respective conductor segments and affecting the loading effects on the driver circuits. It has been found that the present invention is useful in the form described herein with any practical variation of display panel size and concurrent variation in gas channel number and/or length.

The present invention may be embodied in other specific forms without departing from the spirit or essential attributes thereof, and it is therefore desired that the present embodiment can be considered in all respects as illustrative and not restrictive, reference being made to the appended claims rather than to the foregoing description to indicate the scope of the invention.

What is claimed is:

1. A circuit for voltage driving a plurality of capacitive conductor segments in a gas display panel, comprising:

(a) a first complementary transistor pair connected at an intermediate series junction point in series coupled arrangement between a voltage source and a ground return terminal, said pair having a common connection to their respective control elements;

(b) a second complementary transistor pair connected in series coupled arrangement between a voltage source and a ground return terminal, said pair having their respective common junction point connected to said common connection of said first pair's control elements;

(c) a pair of input terminals, each terminal respectively connected to a control element of one of said second complementary transistor pair; and (d) an output terminal connected to the intermediate series junction point of said first complementary transistor pair.

2. The circuit of claim 1, wherein said voltage source is in the range of 150–300 volts.

3. The circuit of claim 2, further comprising a plurality of capacitively loaded conductor segments connected to said output terminal.

4. The circuit of claim 1, further comprising a coupling capacitor respectively connected to each of said input terminals.

5. The circuit of claim 1, further comprising one or more conductor segments connected to said output terminal.

6. A circuit for voltage driving a plurality of capacitive conductor segments in a gas display panel, comprising:

(a) a first complementary transistor pair connected at an intermediate series junction point in series coupled arrangement between a voltage source in the range of 150–300 volts DC., and a ground return terminal, said pair having a common connection to their respective control elements;

(b) a second complementary transistor pair connected in series coupled arrangement between said voltage source and a ground return terminal, said pair having their respective common junction point connected to said common connection of said first pair's control elements;

(c) a pair of input terminals, each terminal respectively connected to a control element of one of said second complementary transistor pair through a coupling capacitor;

(d) an output terminal connected to the intermediate series junction point of said first complementary transistor pair; and (e) a decoupling capacitor connected between a ground return terminal and said voltage source connection to said second complementary transistor pair.

* * * * *